US010030578B2

(12) United States Patent
Gallatz et al.

(10) Patent No.: US 10,030,578 B2
(45) Date of Patent: Jul. 24, 2018

(54) ROTATING PISTON INTERNAL COMBUSTION ENGINE

(71) Applicant: MWI Micro Wave Ignition AG, Empfingen (DE)

(72) Inventors: Armin Gallatz, Empfingen (DE); Volker Gallatz, Sulz-Bergfelden (DE)

(73) Assignee: MWI Micro Wave Ignition AG, Empfingen (DE)

( * ) Notice: Subject to any disclaimer, the term of this patent is extended or adjusted under 35 U.S.C. 154(b) by 90 days.

(21) Appl. No.: 15/148,233

(22) Filed: May 6, 2016

(65) Prior Publication Data

US 2017/0022893 A1 Jan. 26, 2017

(30) Foreign Application Priority Data

Jun. 23, 2015 (EP) ..... 15173423

(51) Int. Cl.

| | |
|---|---|
| ***F02B 55/14*** | (2006.01) |
| ***F02P 23/04*** | (2006.01) |
| ***F02B 53/12*** | (2006.01) |
| *F02P 15/00* | (2006.01) |

(52) U.S. Cl.

CPC ..... *F02B 55/14* (2013.01); *F02B 53/12* (2013.01); *F02P 23/045* (2013.01); *F02P 15/005* (2013.01)

(58) Field of Classification Search

CPC ..... F02B 55/14; F02B 55/12; F02P 23/045; F02P 15/005

USPC ..... 123/210

See application file for complete search history.

(56) References Cited

U.S. PATENT DOCUMENTS

| | | | | | |
|---|---|---|---|---|---|
| 2,617,841 | A * | 11/1952 | Linder | F02P 23/04 | 123/143 B |
| 3,934,566 | A * | 1/1976 | Ward | F02P 9/007 | 123/143 B |
| 4,064,852 | A * | 12/1977 | Fulenwider, Jr. | F02M 27/04 | 123/25 B |
| 4,138,980 | A * | 2/1979 | Ward | F02P 23/045 | 123/143 B |
| 4,314,530 | A * | 2/1982 | Giacchetti | F02P 23/04 | 123/143 B |

(Continued)

FOREIGN PATENT DOCUMENTS

| | | | | |
|---|---|---|---|---|
| DE | 340034 A1 | 7/1985 | | |
| DE | 3400034 A1 * | 7/1985 | | F02P 23/04 |

(Continued)

*Primary Examiner* — Jason Newton

(74) *Attorney, Agent, or Firm* — Von Rohrscheidt Patents

(57) ABSTRACT

A rotating piston internal combustion engine including a housing which includes a housing wall that forms an operating chamber, and in which housing a rotatable rotating piston is arranged which extends through the operating chamber and moves edges of the rotating piston along the housing wall that forms a running surface, wherein a portion of the operating chamber functions as a combustion chamber together with an associated combustion chamber wall for igniting a fuel that is arranged in the operating chamber, characterized in that at least one microwave window is arranged in the combustion chamber wall, wherein a device for injecting microwave energy in a form of microwaves into the combustion chamber of the operating chamber is arranged at a side of the microwave window that is oriented away from the combustion chamber.

18 Claims, 6 Drawing Sheets

(56) References Cited

U.S. PATENT DOCUMENTS 4,446,826 A * 5/1984 Kimura ..... F02P 23/045 123/143 B
4,556,020 A * 12/1985 Hickling ..... F02B 51/06 123/143 B
4,726,336 A * 2/1988 Hoppie ..... F02P 23/04 123/143 B
5,423,306 A * 6/1995 Trigger ..... F02P 3/01 123/637
5,532,462 A * 7/1996 Butwell ..... B01J 19/126 219/695
5,845,480 A * 12/1998 DeFreitas ..... F02C 7/264 60/776
6,782,875 B2 * 8/2004 Yoshimoto ..... F02B 51/06 123/536
7,900,613 B2 * 3/2011 Heuermann ..... F02P 23/045 123/606
8,424,501 B2 * 4/2013 Storm ..... F02B 23/0654 123/143 B
8,602,005 B2 * 12/2013 Ikeda ..... F02B 1/02 123/143 B
9,551,315 B2 * 1/2017 Smith ..... F02P 9/007
2002/0059907 A1 * 5/2002 Thomas ..... F01B 3/04 123/43 AA
2005/0103307 A1 * 5/2005 Yoshimoto ..... F02B 51/06 123/305
2007/0227138 A1 * 10/2007 Carrott ..... F02G 1/043 60/520
2007/0240660 A1 * 10/2007 Gallatz ..... F02P 23/045 123/143 B
2009/0229581 A1 * 9/2009 Ikeda ..... B01D 53/32 123/536
2010/0236511 A1 * 9/2010 Elkanick ..... F02B 5/00 123/1 A
2014/0109864 A1 * 4/2014 Drachko ..... F01C 1/077 123/200
2014/0224203 A1 * 8/2014 Ikeda ..... F02P 3/01 123/143 B
2014/0261293 A1 * 9/2014 Schulz ..... F02B 19/108 123/209
2014/0261294 A1 * 9/2014 Thomassin ..... F02B 53/10 123/209
2014/0299085 A1 * 10/2014 Ikeda ..... F02B 9/00 123/143 B
2017/0022893 A1 * 1/2017 Gallatz ..... F02B 53/12

FOREIGN PATENT DOCUMENTS

DE 19802745 A1 * 7/1999 ..... F02P 23/045
DE 10356916 B3 * 6/2005 ..... F02P 23/045
DE 10356916 B3 6/2005
JP 07109959 A * 4/1995 ..... F02M 31/16
WO WO 9814703 A1 * 4/1998 ..... F02P 23/045
WO WO9814703 A1 4/1998
WO WO 2005059356 A1 * 6/2005 ..... F02P 23/045

* cited by examiner

ROTATING PISTON INTERNAL COMBUSTION ENGINE

RELATED APPLICATIONS

This application claims priority from and incorporates by reference European Patent Application 15 173 423.3 filed on Jun. 23, 2015.

FIELD OF THE INVENTION

The invention relates to a rotating piston internal combustion engine with a housing which includes a housing wall that forms an operating chamber and in which a rotatable rotating piston is arranged which extends through the operating chamber and which moves edges of the rotating piston along housing walls forming a running surface during the rotation wherein a portion of the operating chamber is used as a combustion chamber together with an associated combustion chamber wall for igniting a fuel arranged in the operating chamber.

BACKGROUND OF THE INVENTION

Engines of this general type are known in the art. The most well-known embodiment is known under the name Wankel engine. It is known from DE 103 56 916 A1 to generate a space ignition in a combustion chamber in an internal combustion engine through microwave energy in order to better ignite and combust a fuel introduced in a fuel air mixture. Subsequently the term fuel is recited in general regardless whether this is diesel, gasoline, hydrogen or another fuel suitable for operations. In order to implement an ignition of a fuel, fuel air mixtures are introduced in the combustion chamber. This is not recited in the text separately in a context with the invention and considered a self-evident pre condition.

In a conventional rotating piston internal combustion engine an ignitable gasoline air mixture is compressed in the operating chamber into a combustion chamber and brought to a reaction/oxidation by a spark plug. The spark plug forms an indentation in the surface of the combustion chamber so that the surface that functions as a running surface for the edges of the rotating piston is uneven which leads to a loss of compression. Furthermore the ignition has the effect that the chemical oxidation spreads spherically from a ignition location in the form of a pressure and reaction front (laminar combustion gas phase) in the elongated and flat combustion chamber and causes a laminar combustion which also leads to a loss of compression. This causes efficiency losses and emissions during the combustion of fuels like e.g. soot or carbon monoxide etc.

BRIEF SUMMARY OF THE INVENTION

Thus, it is an object of the invention to facilitate an improved ignition of a fuel in a combustion chamber and an improvement in efficiency.

This object is achieved according to the invention by a rotating piston internal combustion engine with a housing which includes a housing wall that forms an operating chamber and in which a rotatable rotating piston is arranged which extends through the operating chamber and which moves edges of the rotating piston along housing was forming a running surface during the rotation wherein a portion of the operating chamber is used as a combustion chamber together with an associated combustion chamber wall for igniting a fuel arranged in the operating chamber.

According to the invention at least one microwave window is arranged in the combustion chamber wall wherein a device for introducing microwave energy in the form of microwaves into the combustion chamber of the operating chamber is arranged in the combustion chamber wall on a side of the microwave window that is oriented away from the combustion chamber. Microwave window in this context means an outward closed portion which is microwave permeable. The combustion chamber wall is configured as a portion of the housing wall is thus used as a running surface also in the portion of the combustion chamber. By arranging the microwave window in the combustion chamber wall it is possible as a matter of principle to produce a completely smooth surface which is particularly advantageous for sealing the rotating piston during its movement along the running surface. Thus, also the compression loss is prevented that occurs in conventional engines. As required one or plural microwave windows can be arranged in the combustion chamber wall wherein it is not necessary for the material of the microwave window to differ from a remaining material of the combustion chamber wall or the housing wall. It is important that the portion that acts as a microwave window is microwave permeable contrary to its environment. Thus, the permeability of the microwave window can be either implemented by a defined portion made from microwave permeable material or by a larger portion which is microwave permeable but is microwave impermeable besides the microwave window through shields against microwaves impacting the section wherein the shields are applied everywhere with an exception of the portion acting as a microwave window. A device for injecting microwave energy is arranged on a side of the microwave window that is oriented away from the combustion chamber. The device for injecting the microwave energy includes either at least one microwave spark plug in a bore hole in the combustion chamber wall which microwave spark plug is connectable through a microwave hollow conductor to a microwave impulse generator or a microwave impulse generator directly attached at the housing and adapted thereto.

Through injecting microwave energy it is possible to ignite the fuel that is arranged in the combustion chamber. Thus, local ignition is replaced by a space ignition or a boundary layer ignition, wherein the fuel is excited before igniting as homogeneously as possible over the entire volume of the combustion chamber which is provided by an absorption of the microwave energy by the fuel particles which absorption is distributed over the combustion chamber. Thus, an absorption capability of microwaves described by a material parameter tan $\delta(t)$ and the associated penetration depth play an important role. The microwave energy is concentrated in sufficient quantity at as many places in the combustion chamber as possible in order to generate a space ignition in the combustion chamber through a plurality of ignition cores. Simultaneously as little microwave energy as possible shall be reflected back to the microwave source. The smaller the reflection, the greater the absorption and thus the energy absorption of the fuel particles for a space ignition.

According to an advantageous embodiment at least the combustion chamber wall is arranged in the housing wall forming the operating chamber without changes to the running surface through indentations like in conventional engines. This means that the combustion chamber wall does not include one or plural separate microwave windows but the entire combustion chamber wall is essentially made from the same material and in this combustion chamber wall one or plural microwave windows thus locations are integrated which are permeable for the microwaves without causing any unevenness in the running surface. This can be provided in that either only the combustion chamber wall is integrated in the housing wall or an entire additional wall layer is arranged on the entire housing wall enveloping the operating cavity in addition to the combustion chamber wall so that the operating chamber is covered with this additional wall layer.

Advantageously the combustion chamber wall is at least partially made from a particularly suitable microwave permeable material like a ceramic material or sapphire glass. This can be in particular also a ceramic material advantageously with a purity greater than 99% or another solid material that is permeable for microwaves. This can be provided in that the combustion chamber wall either includes individual portions made from this material or in that it is entirely made from this material and portions are formed therein by additional measures which allow the microwave energy to pass in a controlled manner and thus form the respective microwave window.

According to another advantageous embodiment of the invention uneven local geometric structures are arranged in the combustion chamber wall which reflect microwaves that have the reflected out of the combustion chamber back into the combustion chamber in a concentrated or scattered manner depending on the configuration. These local structures can thus either have a curved or uniform configuration like for example harmonic oscillations, e.g. a sine wave or a configuration with edges. It is also possible to configure the structure by elements configured as spheres or similar. These structures facilitate achieving a controlled reflection or scattering of microwaves so that a fuel can be energized and ignited by local field augmentation in combustion chamber portions in which an ignition of the fuel would normally not be performed.

Advantageously the uneven local geometric structures are configured as particles introduced into the combustion chamber wall or as a metal powder layer. This metal powder layer is for example applied onto a pressed pre sintered carrier layer (green blank) when using ceramic material, wherein the uneven portions can already be provided or are produced in this phase by known fabrication methods, like rolling, milling etc. The surface thus prepared can now be vapor deposited with metal, doted with metal powder or treated in another known and suitable manner in order to provide it with a metal layer. Subsequently holes can be produced by a laser, by etching or with another known method, wherein the holes facilitate a passage of microwaves and are being used as a microwave window. Subsequently a microwave permeable additional layer is applied which can be made from a ceramic material or sapphire glass. Advantageously additional precision grinding can be used to produce an insert that is insertable into the housing wall or also the piston wall wherein the insert can be secured against rotation by form locking.

According to another advantageous embodiment the combustion chamber wall is provided with a metal layer on a side that is oriented away from the combustion chamber or within the combustion chamber wall wherein the layer extends in a longitudinal direction of the combustion chamber wall and includes at least one opening for passing microwaves through. The metal layer can thus be vapor deposited on an outside, wherein respective openings are etched out as required by the respective application. For the application within the combustion chamber wall a metal layer is arranged that extends in the longitudinal direction of the combustion chamber wall and which includes at least one opening for passing microwaves through similar to the way described supra in conjunction with the local metal structures. This wall can be inserted sprinkled in, vapor deposited, co-sintered and fired when producing the housing wall in particular from ceramic material. The microwaves are reflected by the metal rotating piston after being injected into the combustion chamber and impact the metal housing of the motor through the ceramic material of the combustion chamber wall and are reflected back from there in a direction towards the combustion chamber. Since the ceramic material also provides a damping of the microwaves the additional metal layer introduced into the ceramic material can be used as a reflection surface which shortens the microwave path through the ceramic material. It is appreciated that the metal surfaces include openings where the microwaves are injected.

In another embodiment of the rotating piston combustion engine according to the invention the device for injecting the microwaves includes at least one microwave pulse generator arranged at the housing through which the microwaves are injected into the combustion chamber. A microwave pulse generator of this type is described in EP 15 170 029.1. The at least one applied microwave pulse generator is either arranged exactly at the respective location of the microwave window or a distribution is performed through a channel in the housing wall which acts as a hollow microwave conductor. The at least one microwave pulse generator is advantageous arranged in an axial direction so that the microwaves are laterally introduced into the housing wall, advantageously parallel to a longitudinal housing axis. Thus, with a suitable arrangement using one or plural arranged microwave channels and a plurality of rotating piston combustion engines arranged in sequence and operating on a common drive shaft the microwaves after being introduced into the housing wall of the first rotating piston internal combustion engine can also be introduced into the rousing walls of the subsequent rotating piston internal combustion engines in order to be injected into the respective combustion chamber.

Advantageously this embodiment includes at least one microwave channel that is arranged in the housing wall, wherein the microwave channel is connected with at least one microwave window. This microwave channel can be subsequently introduced into the housing wall, e.g. by milling or other suitable measures or the microwave channel can be introduced into a ceramic layer of the combustion chamber wall already before the final sintering. The surface of the at least one microwave channel can be additionally provided with a metal layer which is interrupted in locations where the microwaves exit from the microwave channel. Thus, the microwave energy can be introduced into the combustion chamber in a controlled manner, since the microwaves that oscillate in the microwave channel are reflected from the walls can exit from the at least one opening. As a matter of principle the microwave channel can also include branch offs where this is advantageous. The microwave channel can also be formed by the microwave permeable material of the combustion chamber wall, wherein the metal housing wall forms a reflective side of the microwave channel. Where required a metal reflection layer can be applied to the microwave permeable material. In an arrangement with plural rotating piston internal combustion engines such microwave channels can be arranged in sequence behind each other. Since ignitions are performed at various points in time in the individual combustion chambers in this arrangement the microwaves are introduced through all openings or microwave channels but only create an ignition in a combustion chamber in which the fuel is in a respective ignitable condition.

In another advantageous embodiment the device for injecting the microwaves includes a microwave spark plug according to patent application EP 15 157 298.9 that is arranged in at least one bore hole in the combustion chamber wall. The microwave spark plug terminates with its end at the microwave permeable combustion chamber wall which forms the microwave window for the microwave spark plug.

Since the rotating piston is typically made from a metal material a surface of the rotating piston already forms a reflection layer for the microwave. In another advantageous embodiment of the invention at least a partial reflection layer is arranged on the rotating piston wherein the partial reflection layer is made from a material that is permeable for the microwave energy and suitable for combusting the fuel in the combustion chamber, in particular ceramic material or sapphire glass, in which uneven local geometric metal structures are arranged which reflect microwaves that impact the rotating piston back into the combustion chamber in a concentrated or scattered manner depending on the configuration. The geometric metal structures as described supra in a context with such structures in the combustion chamber wall can be produced without pass through openings for microwaves. Advantageously the uneven local geometric structures are configured as particles introduced into the reflection layer and/or as a metal powder layer. Thus, the concentration or the scattering of the microwaves in the combustion chamber can be controlled.

According to an advantageously embodiment the combustion chamber wall and/or the reflection layer are configured at least partially as a prefabricated sintered insert that is insertable into the housing wall or into the piston wall. This can be performed so that either only the combustion chamber wall is introduced in the housing wall or the housing wall is coated with a wall layer enveloping the entire chamber. The same applies to the metal rotating piston which can also be completely enveloped by a wall layer of this type. This facilitates producing rotating piston internal combustion engines of this type.

According to another embodiment of the invention the device for injecting the microwaves includes a microwave generator which generates microwaves with a frequency of 25 GHz to 95 GHz, advantageously 30 GHz to 75 GHz and which includes a control for a point in time a frequency an amplitude and a type of microwave injection. Type of the injection means whether the injection is performed by individual impulses or in impulse packets or in other possibly required variant of microwave control.

Advantageously the device for injecting microwaves can include a microwave generator which injects the microwaves in impulse packets and advantageously maintains the microwaves also after the ignition of the fuel has been performed. Thus, in addition to the ignition the combustion of the fuel is optimized and the combustion of the fuel is excited even after the ignition has been performed.

A particular advantage of the engine is that the microwaves can be injected in manner that is controlled relative to crank shaft angle so that a precise control of the ignition can be performed. Furthermore it is possible to configure a rotating piston internal combustion engine of this type without a seal between the rotting piston and the housing wall, e.g. with a gap of 0.5 mm without losing a substantial amount of power which simplifies fabrication.

The engine according to the invention avoids the known disadvantages of compression loss by a running surface that has no uneven areas and a space ignition of individual fuel particles is avoided. It is possible to provide any required ignition energy at any point in space and to generate an even combustion in the entire combustion chamber by selecting a number of microwave windows and respective parameters for injecting the microwaves accordingly. The running surface can be configured in all suitable variations. An operating chamber with a circular cross section is also feasible. Furthermore the material and the configuration of the housing of the motor can be selected according to particular requirements in particular when a sinter material like a ceramic material used.

The engine according to the invention facilitates a more precise control of a beginning of a space ignition of a fuel in a combustion chamber so that an optimum low emission combustion of the fuel is achieved with an efficiency that is increased over conventional rotating piston combustion engines. In general the invention facilitates a safe ignition of lean fuel air mixtures which renders an additional enriching for ignition purposes unnecessary and which leads to a low fuel consumption. Emissions and their generation can be controlled by the combustion temperature and the mixing ratio of air and fuel. A combustion according to the invention works quicker than for conventional ignition systems. This causes a "colder" combustion so that efficiency is increased. Furthermore lower emissions are achievable as a matter of principle with colder combustion cycles. A colder combustion reduces a concentration of nitrous oxides in the fuel exhausts. Using a space ignition the combustion process differently from a conventional combustion process is much less dependent from a combustion progress in a form of diffusion flames. Thus additional heat losses are prevented and an efficiency increase is achieved. A heat up phase of the combustion chamber and of the air in the oxidation portion is significantly reduced for this type of combustion.

BRIEF DESCRIPTION OF THE DRAWINGS

The invention is subsequently described in more detail with reference to drawing figures. Additional features of the invention can be derived from the subsequent description in combination with the patent claims and the appended drawing figures, wherein:

DETAILED DESCRIPTION OF THE INVENTION

Figure 1A:
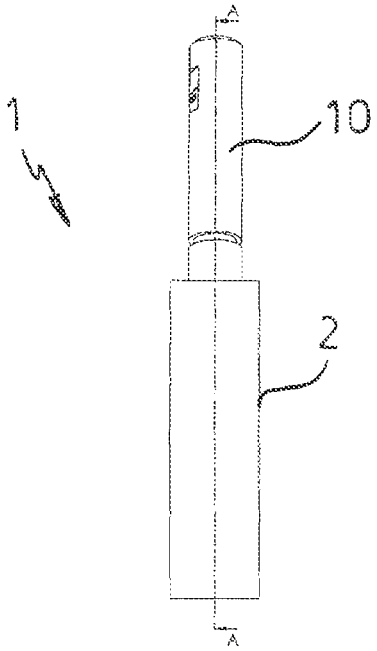
FIG. 1A illustrates a schematic view of a rotating piston internal combustion engine with a microwave pulse generator which is arranged in the housing of the rotating piston internal combustion engine at a slant angle in a face view.
Figure 1B:
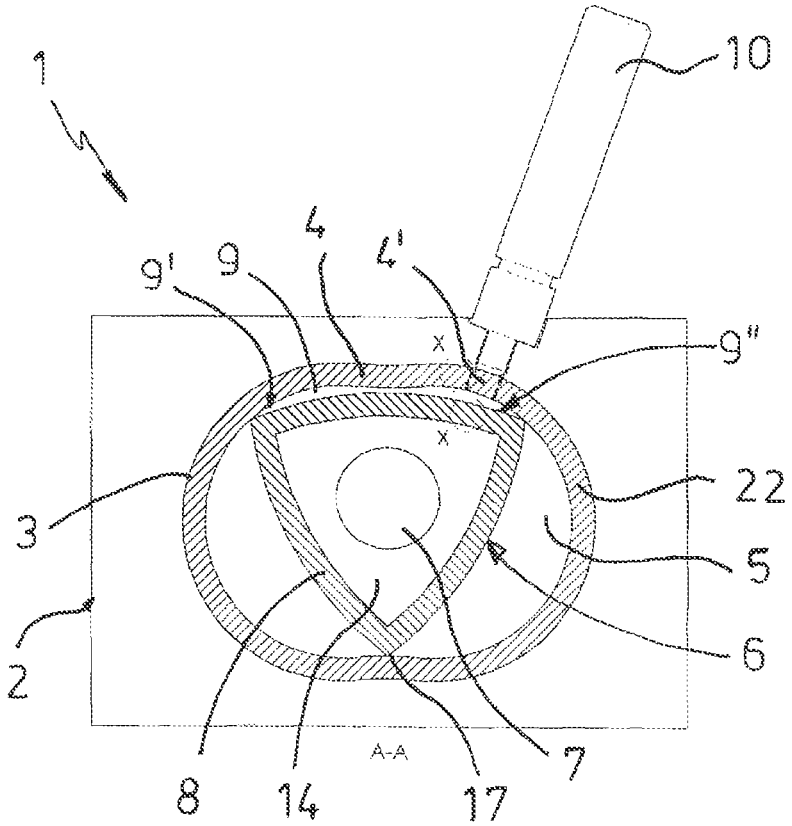
FIG. 1B illustrates a schematic cross sectional view of the housing of FIG. 1A along the line AA of FIG. 1A.
Figure 1C:
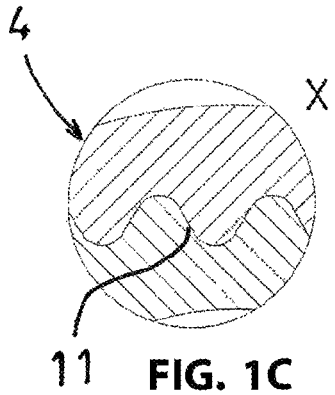
FIG. 1C illustrates an embodiment of a detail X of FIG. 1B of the housing wall and the rotating piston wall oriented towards the operating cavity.
Figure 1D:
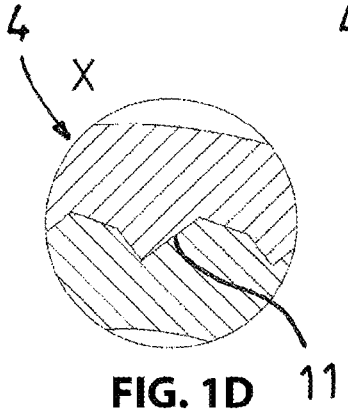
FIG. 1D illustrates an embodiment of a detail X of FIG. 1B of the housing wall and the rotating piston wall oriented towards the operating cavity.
Figure 1E:
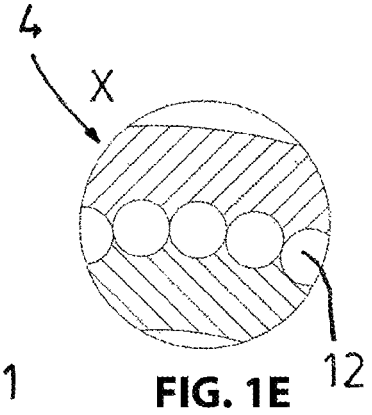
FIG. 1E illustrates an embodiment of a detail X of FIG. 1B of the housing wall and the rotating piston wall oriented towards the operating cavity.
Figure 2A:
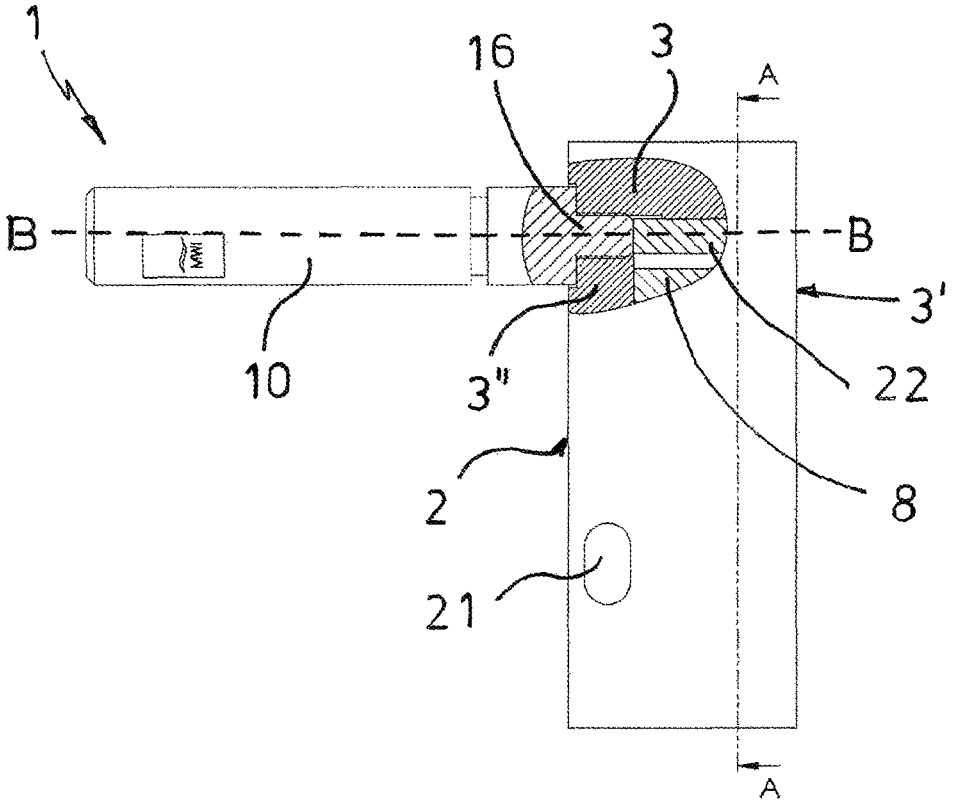
FIG. 2A illustrates a schematic view of a rotating piston internal combustion engine with a microwave pulse generator which is arranged an axial direction in the housing of the rotating piston internal combustion engine in a face view.
Figure 3:
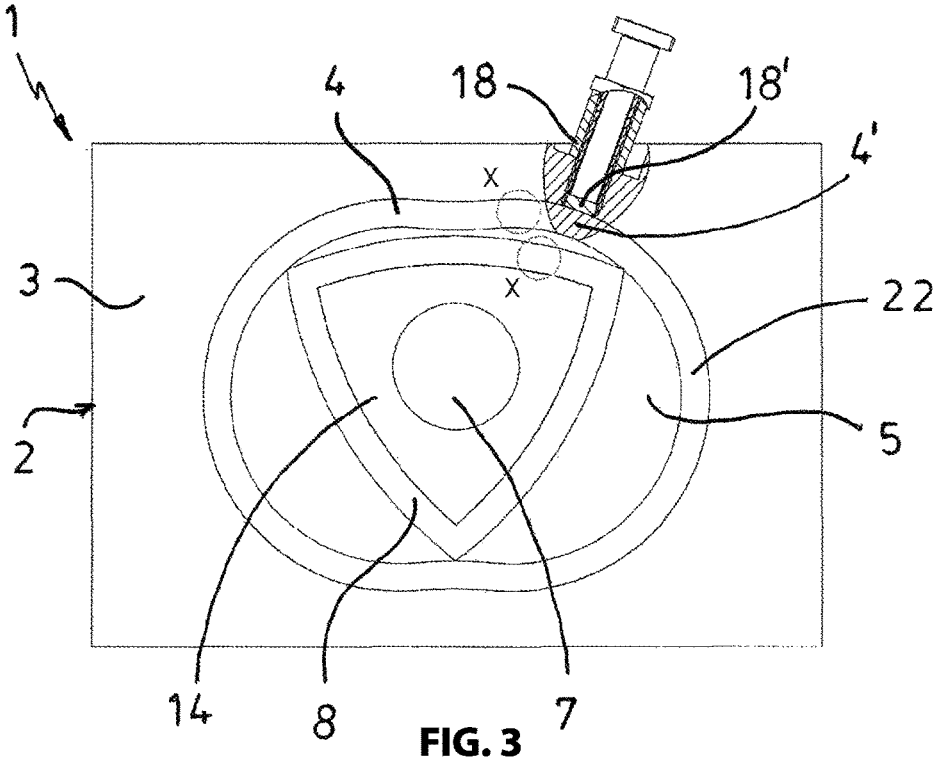
FIG. 3 illustrates a schematic cross sectional view similar to FIG. 1B with a microwave spark plug in place of the microwave pulse generator.

FIGS. 1A-E and 2A, B illustrate two different embodiments of the engine 1 which differ in that the microwave pulse generators 10 are arranged differently. FIG. 3 illustrates an arrangement of a microwave spark plug 18 in place of the microwave pulse generator in FIGS. 1A-E. The description of the engine 1 with a housing 2 and the arrangements included therein furthermore applies to the embodiments in FIGS. 1A-E, 2A, B and 3. This also applies for the details X in the figures which are only illustrated in FIGS. 1C, 1C and 1E.

Figure 4A:
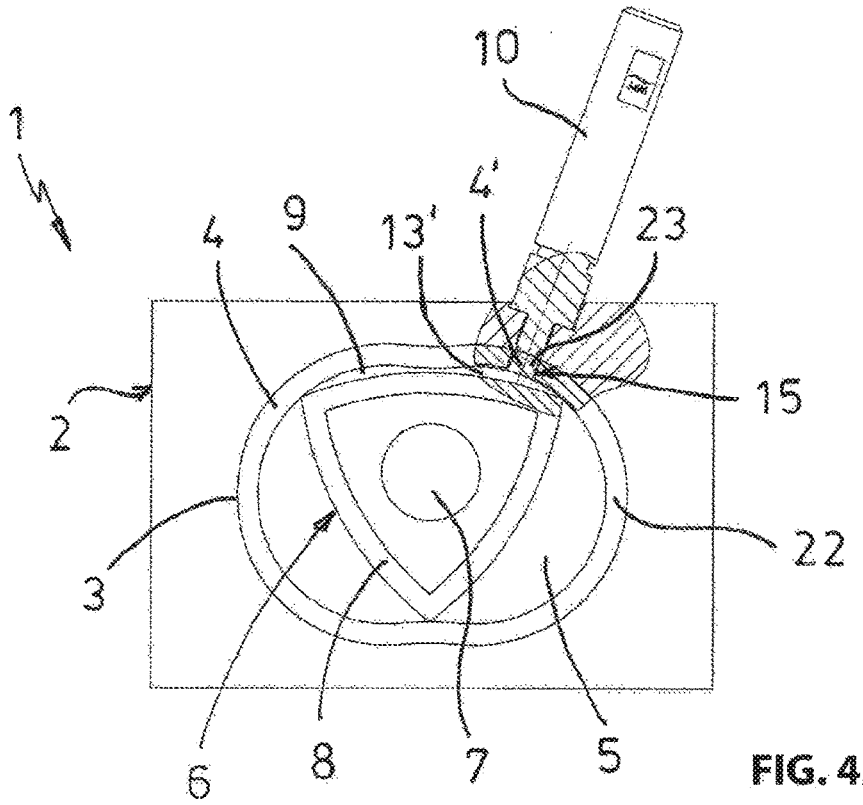
FIG. 4A illustrates a schematic view according to FIG. 1B with a plan view cross section with plural metal coatings of the combustion chamber wall on a side oriented towards the operating chamber.

The engine 1 includes a housing wall 3 with a wall layer 22 which envelops an operating chamber 5 in which a rotating piston 6 is supported rotatable about a rotating axis 7. The edge 17 of the rotating piston 6 moves along the wall layer 22 of the housing wall 3. The portion of the operating chamber 5 in which a fuel is arranged that is compressed by a rotation of the rotating piston 6 is designated as a combustion chamber 9 and a portion of the wall layer 22 that is associated with the combustion chamber 9 is designated as combustion chamber wall 4. At least the combustion chamber wall 4 is made from a microwave permeable material, namely a ceramic material. In the embodiment, however, not only the combustion chamber wall 4 but the entire portion of the housing wall 3 enveloping the operating cavity 5 is fabricated with a wall layer 22 made from a ceramic material. The wall layer 22 is made from inserts. The rotating piston 6 also includes a reflection layer 8 made from a ceramic material. In FIG. 1A and FIG. 1B the microwave pulse generator 10 is arranged at a slant angle relative to the housing 2 and is arranged substantially perpendicular to the divider space wall 4 at the location where it contacts the divider space wall 4. The microwave pulse generator wall 10 can be threaded into the housing 2 or can be attached at the housing 2 with a bayonet closure. The microwave pulse generator 10 is subject matter of the parallel patent application EP 15 17 00 29.1 and includes suitable control devices for controlling the microwaves. The portion 4' in the combustion chamber wall 4 adjoining the microwave pulse generator 10 represents the microwave window through which the microwaves exiting from the microwave pulse generator 10 are injected into the combustion chamber 9. This portion as illustrated in FIGS. 4A, B can also include metal guide surfaces 15 introduced into the divider space wall.

As a matter of principle microwaves are reflected by metal so that the microwaves injected into the combustion chamber 9 are disposed in the entire combustion chamber 9 and can energize and ignite the entire fuel in the combustion chamber 9. Since the rotating piston 6 as well as the housing 2 are typically made from metal the microwaves injected into the combustion chamber 9 are typically reflected back and forth between the rotating piston 5 and the housing 2. When the walls forming the combustion chamber 9 are made from a microwave permeable material like in the embodiment the combustion chamber wall 4 or the reflecting layer 8 on the metal housing 2 or a metal core 14 of the rotating piston 6, the microwaves are attenuated slightly but are still retained in the combustion chamber 9.

Additionally a microwave permeable metal layer 11 can either be arranged in the combustion chamber wall 4 and/or in the reflection layer 8, wherein the metal layer 11 was configured in particular during production of the combustion chamber wall 4 or the reflection layer 8 to guide the reflections of the microwaves or also to shorten a path through the combustion chamber wall up to the reflection. Thus, for example in order to achieve a controlled scattering or concentration during the reflection for example in the combustion chamber portions 9' or 9" a metal layer 11 with wave form according to FIG. 1C or a structured uneven metal layer according to FIG. 1D can be provided as an uneven local geometric structure. At locations where no controlled scattering or concentration is desired the metal layer 11 is flat or adapted to a curvature of the wall layer 22. It is also possible to fabricate metal particles 12 as illustrated in FIG. 1E as illustrated in the combustion chamber wall 4 or the reflection layer 8. Since the metal layer 11 reduces the path through microwave permeable layer of the combustion chamber wall 4 or the reflection layer 8 also the attenuation of the microwaves along the path is reduced. In so far also a flat metal layer 11 or a metal layer 11 that is adapted to a respective curvature can be integrated.

Figure 4B:
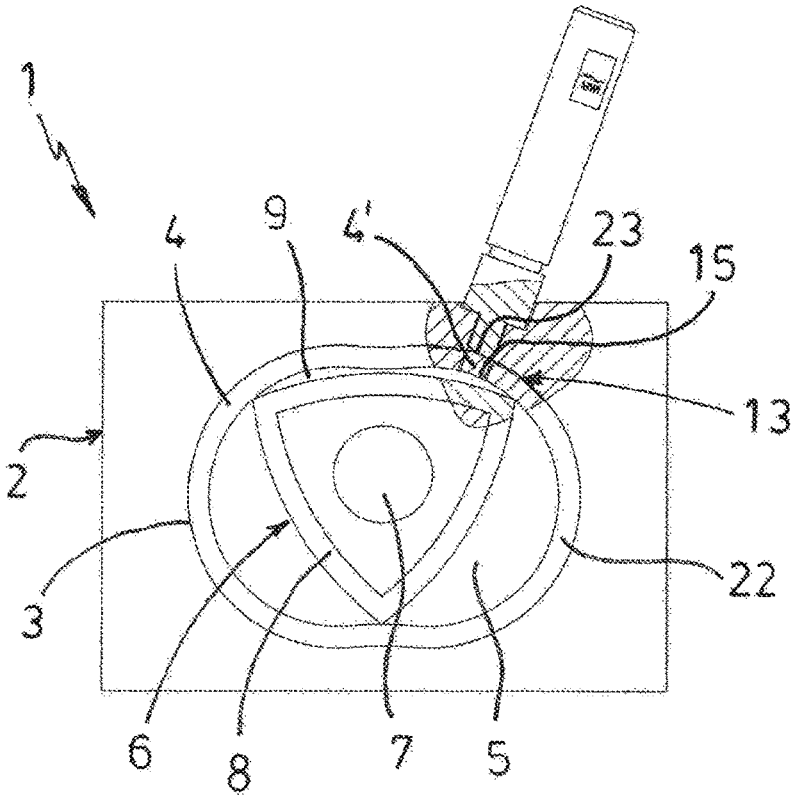
FIG. 4B illustrates a schematic view according to FIG. 1B with a plan view cross section with plural metal coatings of the combustion chamber wall on a side oriented away from the operating chamber.

As evident from FIGS. 1A and 1B the engine includes a narrow housing 2 in which the operating cavity 5 with the schematically indicated rotating piston 6 is arranged. It is an advantage of rotating piston combustion engines of this type that a plurality of such disc shaped rotating piston internal combustion engines can be arranged adjacent to each other which power a common drive shaft that is not illustrated with different ignition timing. In particular for this case it is advantageous to arrange the microwave pulse generator 10 as illustrated in FIGS. 2A, B. This facilitates the distribution of the injected microwaves to all housings 2 of the engine arranged adjacent to each other through accordingly configured channels. As evident from FIG. 2B the microwave pulse generator 10 is arranged so that it injects the microwaves into the microwave permeable combustion chamber wall 4. In this simplest embodiment the combustion chamber wall 4 forms the microwave conducting channel in which a wall of the channel can be formed by the metal housing wall 3 and the other opposite wall can be formed by a metal layer applied to the combustion chamber wall 4 or introduced into the combustion chamber wall 4 which metal layer includes an opening for microwaves to pass through (not illustrated). Without this layer the entire surface oriented towards the combustion chamber 9 already represents the microwave window 4 through which the microwaves are coupled into the combustion chamber 9 as illustrated in FIG. 4. Laterally additional metal surfaces 15 can be introduced into the combustion chamber wall 4 (FIG. 4A, B). FIG. 2A illustrates the metal housing wall 3, wherein the microwaves pulse generator 10 is run through an opening 16 in the lateral wall 3". In case only a disc shaped housing 2 is used the metal opposite wall 3' of the housing 2 is closed. When plural housings 2 are arranged adjacent to each other only the wall 3' of the last housing 2 is closed, whereas all other housings 2 include a respective opening 16 (with or without ceramic filling) in both walls 3' and 3" in order to conduct the microwaves. It is also possible to make the lateral walls 3', 3" for this housing from a ceramic material with metal surfaces in the walls 3' 3" forming the channel.

This microwave conducting channel in a particularly advantageous embodiment can also be configured in the metal housing wall 3. In this case the ceramic layer 22 with its metal inserts forms the microwave openings or the microwave window or the hollow conductor terminal. When the additional microwave permeable metal structures 11 are also arranged in the combustion chamber wall 4 it is required that the portions associated with the openings 16 also include openings in this microwave permeable metal layer 11 (not illustrated). The channel 13 can certainly also include branch offs and can be connected with subsequent additional housings 2 as stated supra.

Figure 2B:
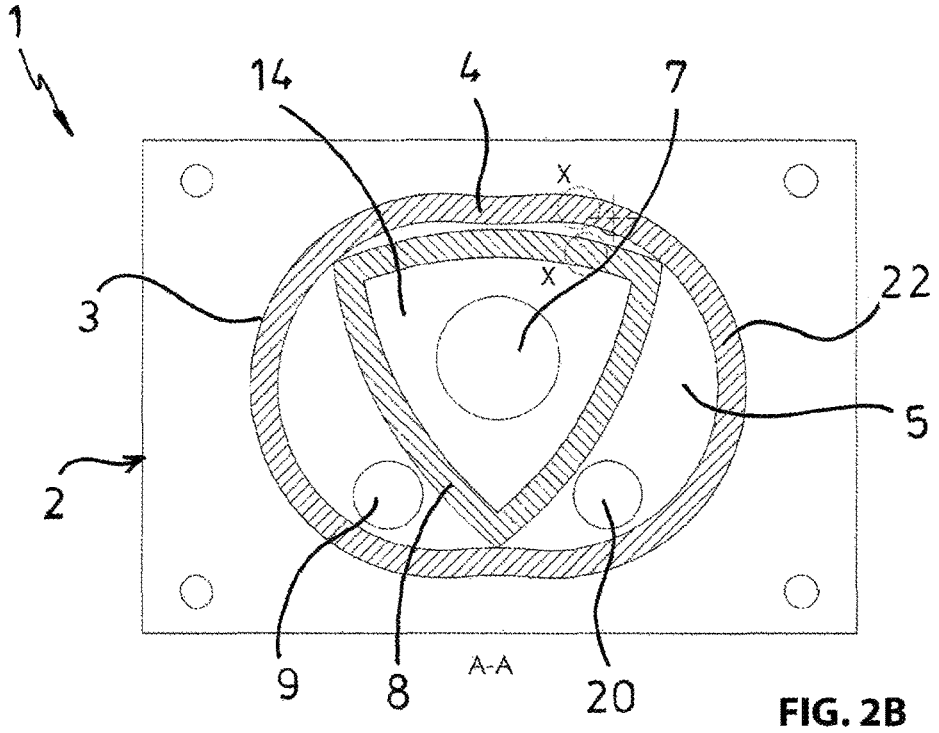
FIG. 2B illustrates a plan view cross section of the housing of FIG. 2A in an attachment portion of the microwave pulse generator in a schematic cross section of the housing along the line AA of FIG. 2A.

In the arrangement of plural engines 1 as described supra the back side of the housing 2 of one engine 1 forms the front side of the housing of the other engine 1. Thus, for a respective configuration of the front and back sides of the disc shaped housing 2 also the distribution of inlet air and outlet air into the operating cavity of the respective housing 2 can be configured accordingly. Thus FIG. 2A illustrates a slotted hole shaped outlet air opening 21 which transitions into a circular air outlet opening 20 in FIG. 2B. Accordingly the air inlet 19 in FIG. 2B is connected with a non-illustrated air opening on another side of the housing 2. An engine that is configured with individual discs as recited supra and thus includes plural pistons is particularly powerful and has a particularly low level of vibrations.

Instead of the microwave pulse generator 10 according to FIG. 1B a microwave spark plug can be inserted into the housing according to FIG. 3, wherein the microwave spark plug 18 contacts the combustion chamber wall 4 with its end. The remaining optional measures described supra with respect to directing the microwaves based on reflections can be maintained. FIG. 3 illustrates the microwave spark plug 18 with a microwave window 18' associated with this microwave spark plug 18, wherein the microwave window however is not mandatory because the ceramic wall layer 22 forms the microwave window 4'. The microwave spark plug 18 is then connected with a suitable non-illustrated microwave pulse generator 10 through microwave hollow conductors.

In FIGS. 4A, B the wall layer 22 in the portion of the combustion chamber wall 4 is provided with an additional metal layer 13 on a side oriented away from the combustion chamber 9, (FIG. 4A) and provided with an additional metal layer 13 on the side of the combustion chamber 9 (FIG. 4B), respectively with an opening 23 for the microwave window 4' and lateral metal surfaces 15. The remaining elements that are identical with the elements in the preceding figures are designated accordingly.

Figure 5A:
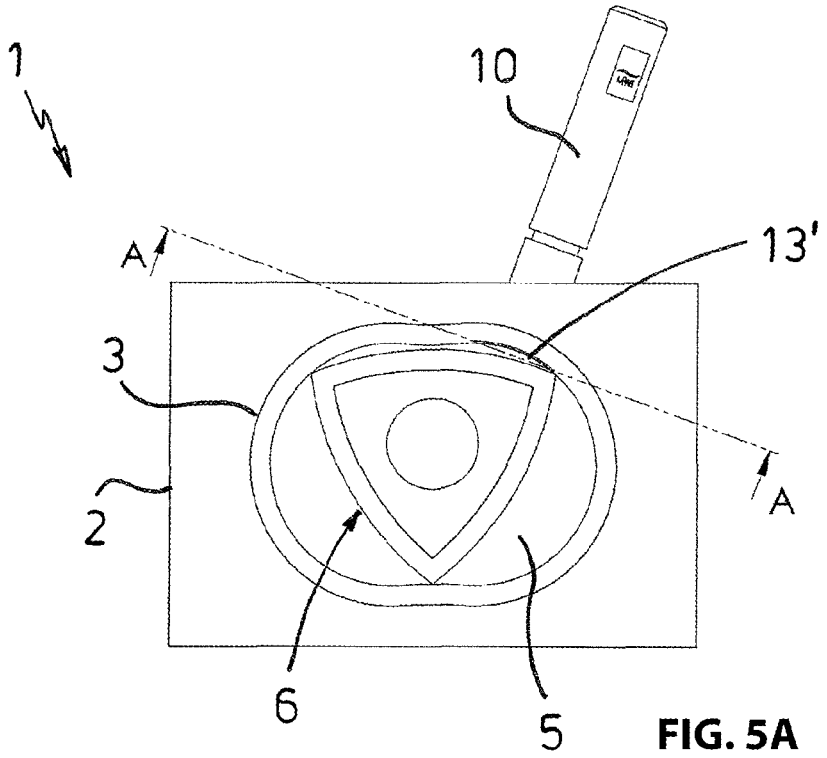
FIG. 5A illustrates a view similar to FIG. 1B.
Figure 5B:
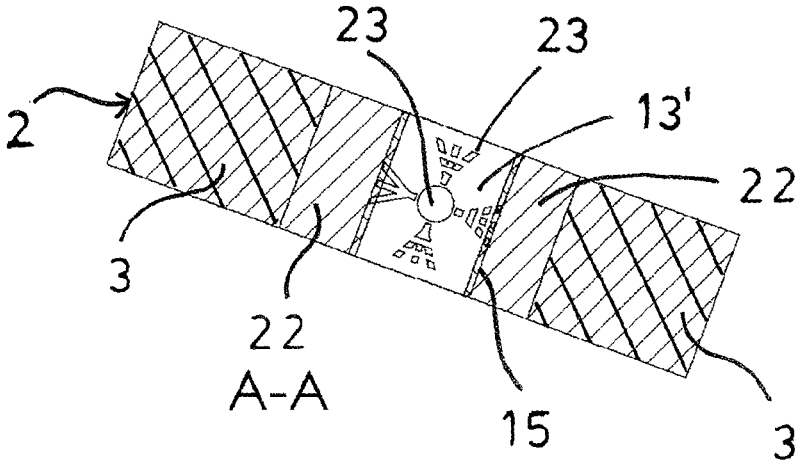
FIG. 5B illustrates a blown up cross sectional view along the line A-A of FIG. 5A with a first arrangement of metal coatings and reflection layers formed therefrom.
Figure 6A:
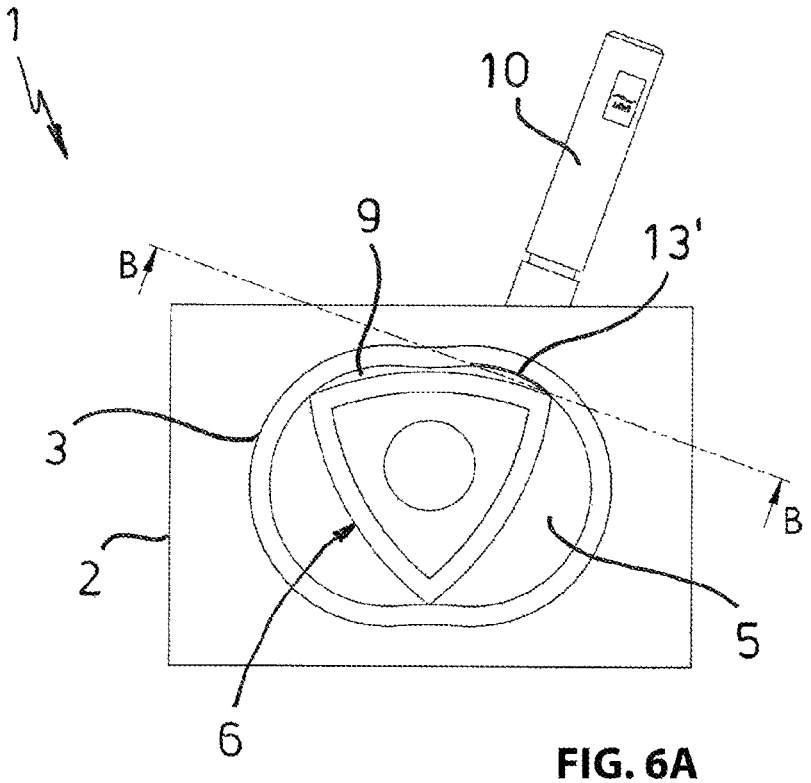
FIG. 6A illustrates a view similar to FIG. 1B
Figure 6B:
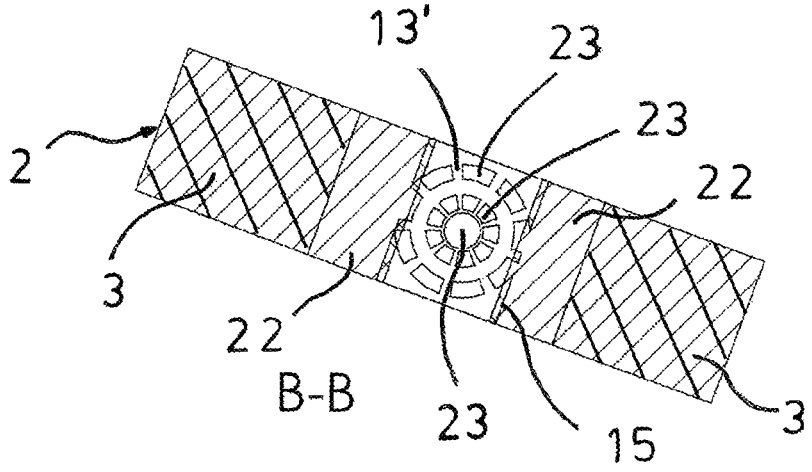
FIG. 6B illustrates a blown up sectional view along the line B-B of FIG. 6A with a second arrangement of metal coatings and reflective layers formed therefrom.

FIGS. 5A, B and 6A, B illustrate optional embodiments of the openings 23 etched out of the metal layer 13' in FIGS. 5B and 68 for influencing the reflections of the microwaves injected into the combustion chamber 9. The remaining elements which are identical with the elements described with respect to FIG. 4 are designated accordingly.

What is claimed is:

1. A rotating piston internal combustion engine, comprising:

a housing which includes a housing wall that forms an operating chamber;

a rotatable rotating piston that is arranged in the housing and extends through the operating chamber and moves edges of the rotating piston along a portion of the housing wall that forms a running surface;

a portion of the operating chamber that functions as a combustion chamber together with a combustion chamber wall so that a fuel that is arranged in the operating chamber is ignitable;

at least one microwave window that is arranged in the combustion chamber wall;

a device configured to inject microwaves into the combustion chamber of the operating chamber; and uneven local geometric metal structures that are arranged in the combustion chamber wall, wherein the device configured to inject microwaves is arranged at a side of the at least one microwave window which side is oriented away from the combustion chamber, wherein the device configured to inject the microwaves is separated by the at least one microwave window from the combustion chamber, wherein at least the combustion chamber wall is at least partially made from a material that is permeable for microwaves and suitable for combusting fuel in the combustion chamber, and wherein the uneven local geometric metal structures reflect microwaves that were initially reflected out of the combustion chamber back in into the combustion chamber in a concentrated or scattered manner.

2. The rotating piston internal combustion engine according to claim 1, wherein the combustion chamber wall and the housing wall have an identical running surface structure, and wherein the combustion chamber wall and portions of the combustion chamber wall that form the at least one microwave window that is permeable for the microwaves have an identical running surface structure without gaps or indentations between the combustion chamber wall and the portions of the combustion chamber wall that form the at least one microwave window.

3. The rotating piston internal combustion engine according to claim 2, wherein the combustion chamber wall and the at least one microwave window are integrally provided in one piece.

4. The rotating piston internal combustion engine according to claim 1, wherein the uneven local geometric metal structures are formed from particles that are introduced into the combustion chamber wall or as a metal powder layer.

5. The rotating piston internal combustion engine according to claim 1, wherein at least a portion of a surface of the rotating piston includes a reflective layer made from a material that is permeable for the microwaves and adapted to a combustion of fuel in the combustion chamber, and wherein the reflective layer includes uneven local geometric metal structures which reflect microwaves impacting the rotating piston back in to the combustion chamber in a concentrated or scattered manner.

6. The rotating piston internal combustion engine according to claim 4, wherein at least the combustion chamber wall and the reflective layer are at least partially configured as a pre-fabricated sintered insert which is insertable into the housing wall or the housing or a piston wall.

7. The rotating piston internal combustion engine according to claim 1, wherein the material is a ceramic material or sapphire glass.

8. The rotating piston internal combustion engine according to claim 1, wherein the combustion chamber wall is provided with a metal layer that extends in a longitudinal direction of the combustion chamber wall, and wherein the metal layer is impermeable for microwaves and includes at least one opening for passing microwaves through.

9. The rotating piston internal combustion engine according to claim 1, wherein the device configured to inject the microwaves includes at least one microwave pulse generator that is arranged at the housing in an axial direction of the housing.

10. The rotating piston internal combustion engine according to claim 9, wherein at least one microwave channel is arranged in the housing wall, and wherein the at least one microwave channel is connected with the at least one microwave window.

11. The rotating piston internal combustion engine according to claim 5, wherein at least the combustion chamber wall or the reflective layer are at least partially configured as a pre-fabricated sintered insert which is insertable into the housing wall or the housing or a piston wall.

12. The rotating piston internal combustion engine according to claim 5, wherein the uneven local geometric metal structures are formed from particles introduced into the reflective layer or as a metal powder layer.

13. The rotating piston internal combustion engine according to claim 12, wherein at least the combustion chamber wall or the reflective layer are at least partially configured as a pre-fabricated sintered insert which is insertable into the housing wall or the housing or a piston wall.

14. The rotating piston internal combustion engine according to claim 12, wherein at least the combustion chamber wall and the reflective layer are at least partially configured as a pre-fabricated sintered insert which is insertable into the housing wall or the housing or a piston wall.

15. The rotating piston internal combustion engine according to claim 5, wherein the material is a ceramic material or sapphire glass.

16. The rotating piston internal combustion engine according to claim 1, wherein the device configured to inject the microwaves includes a microwave spark plug or a microwave generator which directly adjoin the at least one microwave window in the combustion chamber wall.

17. The rotating piston internal combustion engine according to claim 1, wherein the device configured to inject the microwaves includes a microwave generator which generates microwaves with a frequency of 25 GHz to 95 GHz-and which includes a control for at least one of a point in time, a frequency, an amplitude and a type of the injection of the microwaves.

18. The rotating piston internal combustion engine according to claim 1, wherein the device configured to inject the microwaves includes a microwave generator which injects the microwaves in impulse packets controlled by a control device; and wherein the microwave generator maintains the microwaves also after an ignition of fuel has occurred.

* * * * *